US005847303A

United States Patent [19]

Matsumoto

[11] Patent Number: 5,847,303

[45] Date of Patent: Dec. 8, 1998

[54] VOICE PROCESSOR WITH ADAPTIVE CONFIGURATION BY PARAMETER SETTING

[75] Inventor: Shuichi Matsumoto, Hamamatsu, Japan

[73] Assignee: Yamaha Corporation, Hamamatsu, Japan

[21] Appl. No.: 46,978

[22] Filed: Mar. 24, 1998

[30] Foreign Application Priority Data

Mar. 25, 1997 [JP] Japan ..... 9-071075

[51] Int. Cl.[6] ..... G10H 1/36; G10H 7/00

[52] U.S. Cl. ..... 84/610; 434/307 A; 704/207

[58] Field of Search ..... 84/600, 610, 634, 84/661; 434/307 A; 704/205–207

[56] References Cited

U.S. PATENT DOCUMENTS

| | | | |
|---|---|---|---|
| 5,231,671 | 7/1993 | Gibson et al. . | |
| 5,296,643 | 3/1994 | Kuo et al. | 434/307 A |
| 5,301,259 | 4/1994 | Gibson et al. . | |
| 5,428,708 | 6/1995 | Gibson et al. . | |
| 5,477,003 | 12/1995 | Muraki et al. | 434/307 A |
| 5,557,056 | 9/1996 | Hong et al. | 84/610 |
| 5,621,182 | 4/1997 | Matsumoto | 84/610 |
| 5,750,912 | 5/1998 | Matsumoto . | |

OTHER PUBLICATIONS

Keith Lent, "An Efficient Method for Pitch Shifting Digitally Sampled Sounds", Computer music Journal, vol. 13, No. 4, Winter 1989, pp. 65–71.

*Primary Examiner*—William M. Shoop, Jr.
*Assistant Examiner*—Jeffrey W. Donels
*Attorney, Agent, or Firm*—Pillsbury Madison & Sutro

[57] ABSTRACT

A voice processing apparatus modulates an input voice into an output voice according to a parameter set. In the voice processing apparatus, a microphone inputs an audio signal which represents an input voice having a frequency spectrum specific to the input voice. An audio signal processor is configured by a parameter set to process the audio signal according to the parameter set to modify the frequency spectrum of the input voice. A parameter table is provided for storing a plurality of parameter sets, each of which differently characterizes modification of the frequency spectrum by the audio signal processor. A CPU selects a desired one of the parameter sets from the parameter table, and configures the audio signal processor by the selected parameter set. A loudspeaker outputs the audio signal which is processed by the audio signal processor and which represents an output voice characterized by the selected parameter set.

22 Claims, 12 Drawing Sheets

FIG. 2

| | | |
|---|---|---|
| HEADER<br><br>SONG TITLE<br>GENRE<br>SINGER NAME<br>RELEASE DATE<br>PLAY TIME | MUSIC TONE TRACK | VOICE DATA 1<br>VOICE DATA 2 |
| | GUIDE MELODY TRACK | ⋮ |
| | LYRIC WORDS TRACK | |
| | VOICE TRACK | VOICE DATA n |
| | EFFECT TRACK | ⋮ |

FIG.3

| SINGER NAME | ADJUSTMENT COEFFICIENT | FILTER COEFFICIENT |
|---|---|---|
| ○○○○ | $\alpha_1$ | $a_1, a_2, a_3, a_4, a_5, \cdots$ |
| ⋮ | ⋮ | ⋮ |

FIG.9

| VOICE PITCH RANGE | FILTER COEFFICIENT |
|---|---|
| MALE C3~ | $a_1, a_2, a_3, a_4, a_5, \cdots$ |
| MALE C2~B2 | $a_1, a_2, a_3, a_4, a_5, \cdots$ |
| MALE ~B1 | $a_1, a_2, a_3, a_4, a_5, \cdots$ |
| FEMALE C4~ | $a_1, a_2, a_3, a_4, a_5, \cdots$ |
| FEMALE C3~B3 | $a_1, a_2, a_3, a_4, a_5, \cdots$ |
| FEMALE ~B2 | $a_1, a_2, a_3, a_4, a_5, \cdots$ |

FIG.12

<table>
<tr><td rowspan="6">HEADER<br><br>SONG TITLE<br>GENRE<br>SINGER NAME<br>RELEASE DATE<br>PLAY TIME</td><td>MUSIC TONE TRACK</td><td rowspan="6">VOICE DATA 1<br>VOICE DATA 2<br>.<br>.<br>.<br>.<br>.<br>VOICE DATA n<br>.<br>.<br>.</td></tr>
<tr><td>GUIDE MELODY TRACK</td></tr>
<tr><td>LYRIC WORDS TRACK</td></tr>
<tr><td>VOICE TRACK</td></tr>
<tr><td>EFFECT TRACK</td></tr>
<tr><td>PARAMETER TRACK</td></tr>
</table>

VOICE PROCESSOR WITH ADAPTIVE CONFIGURATION BY PARAMETER SETTING

BACKGROUND OF THE INVENTION

1. Field of the Invention

The present invention generally relates to a voice processor for converting a waveform of a singing voice of a karaoke player into another waveform substantially similar to that of an original singer, and relates to a karaoke apparatus using such a voice processor.

2. Description of Related Art

A conventional karaoke apparatus is capable of converting pitch ranges from a male voice to female voice and vice versa to allow a male karaoke player to sing a song originally entitled to and sung by a female professional singer, and otherwise to allow a female karaoke player to sing a song originally sung by a male professional singer. In performing frequency conversion on an audio signal of the singing voice, simply compressing or expanding a waveform of the audio signal results in a curious voice that is heard as if an audio record tape is reproduced in a speed faster or slower than a regular speed, far from resembling a natural human voice.

To overcome this problem, formant shifting is used in the above-mentioned voice pitch range conversion. In the formant shifting, a continuous waveform of about 30 to 60 ms is extracted from an audio signal of a karaoke player by use of a Hamming function. The extracted waveform is arranged at a time interval of a frequency after conversion. By this processing, the frequency of the singing voice is converted while the formant or frequency spectrum characteristic to the karaoke player is retained.

However, even if the above-mentioned voice pitch range converting can help a male karaoke player sing in a female voice and vice versa, this method cannot satisfy a demand by karaoke players to sing in a voice like that of an original professional singer, because the formant before and after the conversion remain unchanged in the conventional method. Further, this demand holds true with respect to situation in which a male karaoke player wants to sing a song originally sung by a male professional singer or a female karaoke player wants to sing a song originally sung by a female professional singer. The conventional karaoke apparatus cannot satisfy such a demand.

SUMMARY OF THE INVENTION

It is therefore an object of the present invention to provide a voice processing apparatus capable of converging a singing voice of a karaoke player into a voice of an original professional singer and to provide a karaoke apparatus using such a voice processing apparatus.

In a first aspect, the inventive voice processing apparatus is constructed for modulating an input voice into an output voice according to a parameter set. The inventive voice processing apparatus comprises an input device that inputs an audio signal which represents an input voice having a frequency spectrum specific to the input voice, a processor device that is configured by a parameter set to process the audio signal according to the parameter set to modify the frequency spectrum of the input voice, a parameter table that stores a plurality of parameter sets, each of which differently characterizes modification of the frequency spectrum by the processor device, a controller device that selects a desired one of the parameter sets from the parameter table, and that configures the processor device by the selected parameter set, and an output device that outputs the audio signal which is processed by the processor device and which represents an output voice characterized by the selected parameter set.

In a second aspect, the inventive voice processing apparatus uses the input device that inputs an input voice in the form of vocal performance of a song originally entitled to a particular singer, the parameter table that stores a plurality of parameter sets which are provisionally prepared in correspondence to different singers including the particular singer, and the controller device that selects the parameter set corresponding to the particular singer whereby the output device outputs an output voice which can emulate vocal performance of the song by the particular singer.

In a third aspect, the inventive voice processing apparatus uses the input device that inputs an input voice having a pitch in a particular range, the parameter table that stores a plurality of parameter sets which are provisionally prepared in correspondence to different ranges including the particular range, and the controller device that selects the parameter set corresponding to the particular range whereby the output device outputs an output voice which can be modulated to adapt to the particular range.

In a fourth aspect, the inventive karaoke apparatus is constructed for generating a karaoke accompaniment to support a singing voice of a karaoke song while modulating the singing voice according to a parameter set. The inventive karaoke apparatus comprises generating means for generating the karaoke accompaniment, input means for inputting the singing voice having a specific frequency spectrum in parallel to the karaoke accompaniment, processing means configurable by a parameter set for processing the singing voice according to the parameter set to modify the frequency spectrum of the singing voice, providing means for providing a plurality of parameter sets, each of which differently characterizes modification of the frequency spectrum of the singing voice by the processing means, control means for selecting a desired one of the parameter sets provided from the providing means and for configuring the processing means by the selected parameter set, and output means for outputting the singing voice which is processed by the processing means and which is modulated according to the selected parameter set to adapt to the karaoke song. In detail, the control means time-sequentially selects the parameter sets provided from the providing means during the course of the karaoke performance, and time-variably configures the processing means by the time-sequentially selected parameter sets so that the output means outputs the singing voice which is time-variably modulated according to the time-sequentially selected parameter sets to dynamically adapt to the karaoke song during the course of the karaoke performance. Further, the inventive karaoke apparatus comprises sequencer means for time-sequentially providing a track of performance data and another track of control data so that the generating means generates the karaoke accompaniment according to the performance data time-sequentially provided from the sequencer means, while the control means time-sequentially selects the parameter sets provided from the providing means according to the control data time-sequentially provided from the sequencer means in synchronization with the performance data.

In carrying out the invention and according to the first aspect thereof, there is provided the voice processing apparatus capable of manipulating the fundamental frequency and the frequency spectrum shape of an audio signal of an input voice so as to convert a male voice into a female voice and vice versa, and to convert the voice quality of one person to that of another person. The degree of the manipulation of the frequency spectrum shape may dominantly determines the resulting waveform of the manipulated audio signal. In view of this, the invention is introduced such that the manner of the manipulation to be performed by the processing means is defined by the parameter.

To be more specific, a plurality of parameters are stored in the parameter table. Selected one of the parameters is sent to the processing means. This novel constitution allows selection of a desired manner of the manipulation by sending a parameter corresponding to the desired manner to the processing means, thereby realizing the manipulation of the audio signal in the desired manner by simple parameter setting operation. This manipulation processing according to the invention is applicable not only to a singing voice but also to a conversational voice.

In carrying out the invention and according to the second aspect thereof, parameters indicative of the characteristics of voices of a plurality of singers are stored. A particular parameter corresponding to a singer whose song has been specified is supplied to the processing means. Based on the received parameter, the processing means makes the waveform of the inputted singing voice signal resemble the waveform of the voice of the particular singer. This setting can be performed by selecting the particular parameter from the parameter table, thereby facilitating manipulation of waveforms of inputted audio signals to convert the same into those resembling various professional singers.

In carrying out the invention and according to the third aspect thereof, parameters corresponding to a plurality of voice pitch ranges are stored in the above-mentioned parameter table. The parameter corresponding to the voice pitch range of an inputted audio signal is supplied to the processing means. This novel constitution allows manipulation of the inputted audio signal according to the voice pitch range corresponding to the audio signal.

In carrying out the invention and according to the fourth aspect thereof, the fundamental frequency of an inputted audio signal and the frequency spectrum shape thereof are processed to convert the singing voice of a karaoke player into a voice quality suitable for the corresponding original karaoke song. The manner of the voice manipulation by this processing means is defined by the corresponding parameter. Since a karaoke song does not have a stable or plain atmosphere throughout the performance, different parameters designed suitably for various scenes of the song are written beforehand in a control data track for executing the karaoke performance. This novel constitution outputs a singing voice of colorful expressions in which voice qualities change for each scene, regardless of the ability or skill of vocal expression of individual karaoke players.

BRIEF DESCRIPTION OF THE DRAWINGS

These and other objects of the invention will be seen by reference to the description, taken in connection with the accompanying drawings, in which:

FIG. 2 is a diagram illustrating a format of song data for use in the above-mentioned karaoke apparatus;

FIG. 3 is a diagram illustrating constitution of a voice change parameter table for use in the above-mentioned karaoke apparatus;

FIG. 9 is a diagram illustrating constitution of a voice change parameter table for use in a karaoke apparatus practiced as a second preferred embodiment of the invention;

FIG. 12 is a diagram illustrating a format of song data for use in a karaoke apparatus practiced as a fourth preferred embodiment of the invention.

DETAILED DESCRIPTION OF PREFERRED EMBODIMENTS

Figure 1:
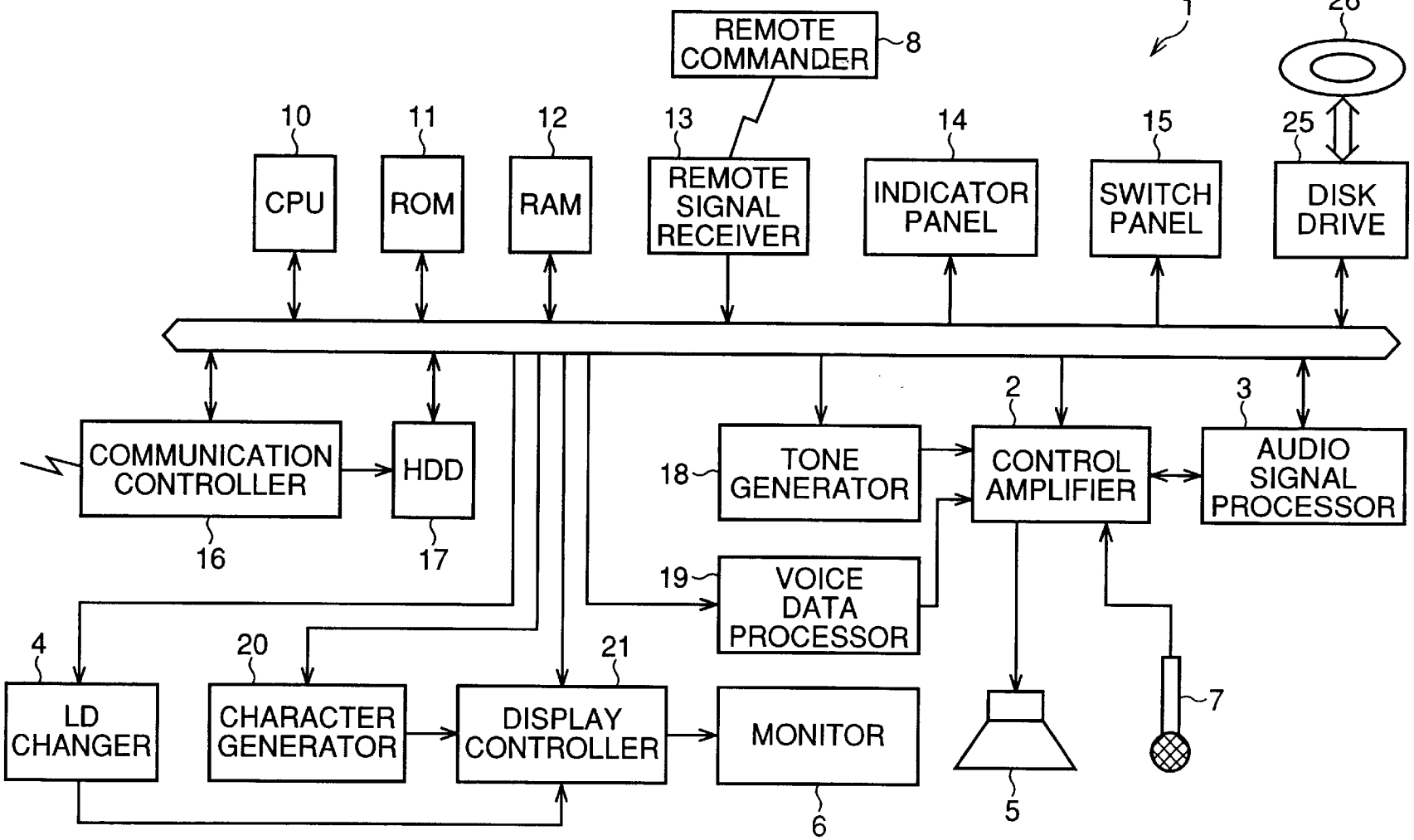
FIG. 1 is a block diagram illustrating a karaoke apparatus practiced as one preferred embodiment of the invention.

This invention will be described in further detail by manner of examples with reference to the accompanying drawings. Now, referring to FIG. 1, there is shown a block diagram illustrating a karaoke apparatus practiced as a first preferred embodiment of the invention. As shown, the karaoke apparatus 1 is composed of a control amplifier 2, an audio signal processor 3, an LD (Laser Disk) changer 4, a loudspeaker 5, a monitor 6, a microphone 7, and an infrared remote commander 8. A CPU 10 is provided in the karaoke apparatus 1 for controlling the operation of the apparatus in its entirety, and is connected to those of a ROM 11, a RAM 12, a hard disk drive (HDD) 17, a communication controller 16, a remote signal receiver 13, an indicator panel 14, a switch panel 15, a tone generator 18, a voice data processor 19, a character generator 20, a display controller 21 and a disk drive 25 through an internal bus. The CPU 10 is also connected to the control amplifier 2, the audio signal processor 3, and the LD changer 4 through an interface and the internal bus.

The ROM 11 stores a starting program and so on for starting this karaoke apparatus. A system program, application programs and so on for controlling the operation of the apparatus are stored in the hard disk drive 17. The application programs include a karaoke play program for example. When the karaoke apparatus is powered on, the starting program loads the system program and the karaoke play program into the RAM 12. The hard disk 17 also stores song data for about 10,000 karaoke songs and a voice change parameter table.

The communication controller 16 downloads song data and the voice change parameter table from a karaoke distribution center through an ISDN (Integrated Services Digital Network) line, and stores the downloaded song data and the voice change parameter table into the hard disk drive 17. The downloaded song data and the voice change parameter table are directly stored in the hard disk drive 17 by use of a DMA (Direct Memory Access) circuit.

The remote commander 8 has various key switches including numeric keys. When a karaoke player operates any of these keys, a code signal indicative of input operation is outputted in the form of infrared radiation. The remote signal receiver 13 receives the infrared code signal radiated from the remote commander 8, restores the code signal, and feeds the same to the CPU 10. The remote commander 8 has a voice conversion mode switch. The voice conversion mode herein denotes waveform modification in which the waveform of a singing voice of the karaoke player is modified to another waveform generally resembling that of a model singing voice of an original professional singer. This modifying capability is turned on/off by the voice conversion mode switch.

The indicator panel 14 is arranged on the front side of the karaoke apparatus 1, and has a matrix of indicators for displaying a song number currently performed and the number of reserved songs and LEDs for displaying currently set key and tempo for example. The switch panel 15 has numeric keys for inputting a song number and another voice conversion mode switch likewise the above-mentioned remote commander 8.

The tone generator 18 forms a music tone signal representing karaoke accompaniment of the requested song based on performance data recorded on a music tone track included in the song data. The music tone track has a plurality of sub tracks. The tone generator 18 forms tone signals of a plurality of parts based on the performance data recorded on these sub tracks. The voice data processor 19 forms an audio signal having a specified length and a specified pitch based on voice data included in the song data. The voice data represents waveforms of voices that can be hardly formed electronically such as a human voice including a background chorus voice. The voice data is stored as PCM signals. The tone signal formed by the tone generator 18 and the audio signal reproduced by the voice data processor 19 are inputted in the control amplifier 2.

The control amplifier 2 is connected with the microphone 7, through which an audio signal representative of a singing voice of the karaoke player is inputted. In the normal mode, the control amplifier 2 imparts a predetermined effect such as echo to a karaoke performance tone, a background chorus voice, and the inputted singing voice, mixes these sounds with a predetermined balance, and outputs the mixed result to the loudspeaker 5. On the other hand, in the voice conversion mode, the control amplifier 2 does not process the audio signal inputted through the microphone 7, but passes the inputted signal to the audio signal processor 3. Then, the control amplifier 2 imparts an effect, and amplifies the audio signal reentered from the audio signal processor 3, thereafter outputting the result from the loudspeaker 5. In the voice conversion mode, the audio signal processor 3 converts the waveform of the audio signal inputted from the control amplifier 2 into another waveform emulating the voice of the original singer.

The character generator 20 generates a character pattern of a title and lyric words of a song based on inputted character data. The LD changer 4 is an externally attached device, and reproduces a moving picture video as a background video based on video select data inputted from the CPU 10. For the video select data, genre data for example recorded in the header of the song data is used. The display controller 21 superimposes the character pattern inputted from the character generator 20 onto the background video inputted from the LD changer 4, and displays a resultant superimposed video onto the monitor 6.

The disk drive 25 receives a machine readable medium 26 such as a floppy disk for use in the karaoke apparatus 1 having the CPU 10 for generating a karaoke accompaniment to support a singing voice of a karaoke song while modulating the singing voice by the processor 3 configurable by a parameter set for processing the singing voice according to the parameter set to modify a frequency spectrum of the singing voice. The machine readable medium 26 contains program instructions executable by the CPU 10 for causing the karaoke apparatus 1 to perform the method of generating the karaoke accompaniment.

FIG. 2 is a diagram illustrating a format of song data for use in the above-mentioned karaoke apparatus 1. The song data is composed of a header, a music tone track, a guide melody track, a lyric words track, a voice track, an effect track, and a voice data part. The header records index data associated with attributes of this song such as title, genre, original singer name, release date, and play time. The music tone track is written in a MIDI (Musical Instrument Digital Interface) format constituted by plural pieces of event data and duration data indicative of a temporal interval between successive event data. The data recorded on the lyric words track through effect track are not music tone data, but these pieces of data are also written in the MIDI format in order to integrate implementation and to facilitate data work processes.

The music tone track is composed of a plurality of parts in order to form a plurality of music tone signals by driving the tone generator 18. The guide melody track records the main melody of the karaoke song, or data of the melody to be sung by the karaoke player. The lyric words track records sequence data for displaying the lyric words of the song onto the monitor 6. The event data recorded on the lyric words track is composed of the character code of the lyric words and a display position of the character code. The voice track specifies the sound timing of a group of voice data recorded in the voice data part, for example. The voice data part records PCM data representative of human voice. The event data recorded in the voice track specifies which voice data is to be reproduced in that event timing. The effect track records effect control data for controlling the control amplifier 2. The control amplifier 2 operates based on this effect control data for imparting the effect of reverberation type such as echo to the music tone signal. When karaoke performance starts, the perforamce data recorded in the above-mentioned tracks are read in parallel based on a tempo clock and are fed to respective processing units. The event data recorded in the music tone track is outputted to the tone generator 18. The data in the lyric words track is outputted to the character generator 20. The data in the effect control track is outputted to the control amplifier 2.

FIG. 3 shows constitution of a voice change parameter table to be set to the hard disk drive 17. A voice change parameter configures the audio signal processor 3 and defines the operation of the audio signal processor 3. The voice change parameter includes at least a set of an adjustment coefficient and a filter coefficient. The adjustment coefficient is a parameter to be supplied for compression and expansion of the audio signal by the audio signal processor 3. This parameter specifies the degree of correcting the formant of the audio signal inputted by the karaoke player. The filter coefficient is a parameter to be supplied to a filter of the audio signal processor 3. This parameter specifies the shape of a human voice tract and resonator which is simulated by the filter.

As described, this karaoke apparatus stores about 10,000 songs of karaoke titles. The voice change parameter table lists voice change parameters obtained by extracting the characteristics of voices of original singers of these karaoke songs. To be more specific, the adjustment coefficient is set to a value that lowers the formant of the karaoke player if the voice of the original singer is thick; if the voice of the original singer is thin, the adjustment coefficient is set to a value that raises the formant of the karaoke player. The filter coefficient is set to a value for simulating the shape of the voice tract or resonator obtained by analyzing the voice quality of the original singer. Likewise the song data, the contents of the voice change parameter table are also downloaded from the karaoke center as required for maintenance or updating. When song data of a new singer is downloaded, the voice change parameter of the new singer is also downloaded, and written to the voice change parameter table.

Figure 4A:
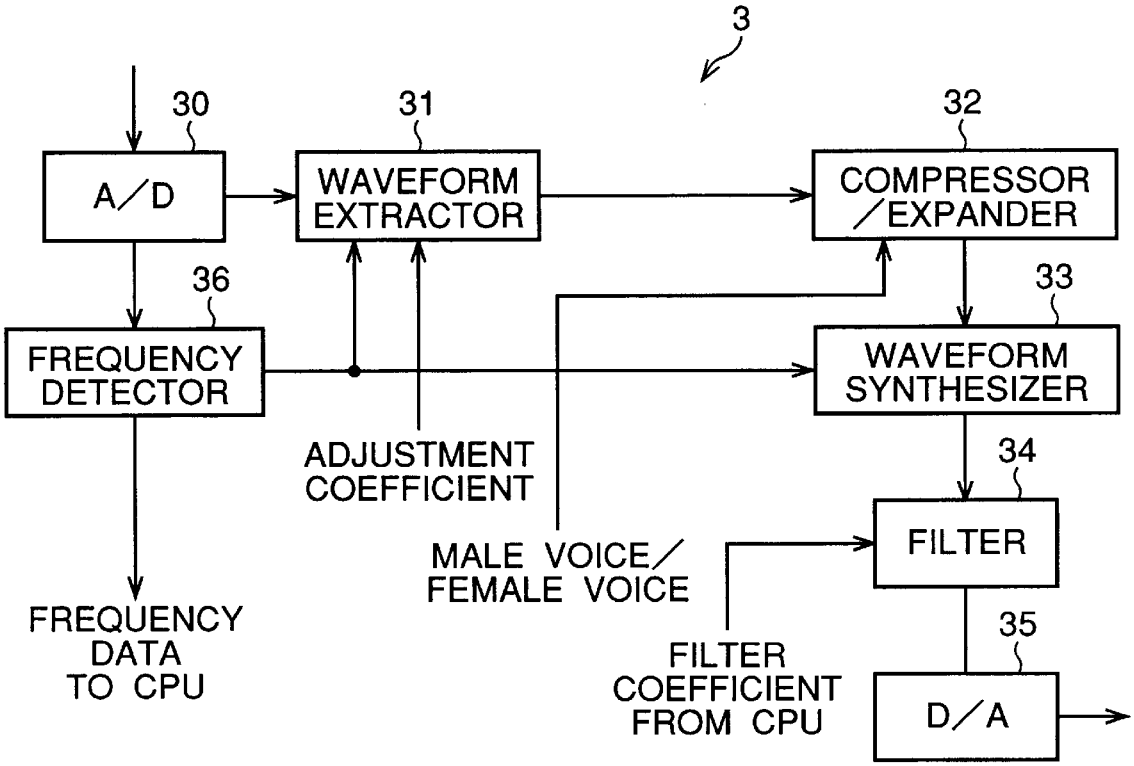
FIG. 4(A) and FIG. 4(B) are functional block diagrams illustrating an audio signal processor included in the above-mentioned karaoke apparatus.
Figure 4B:
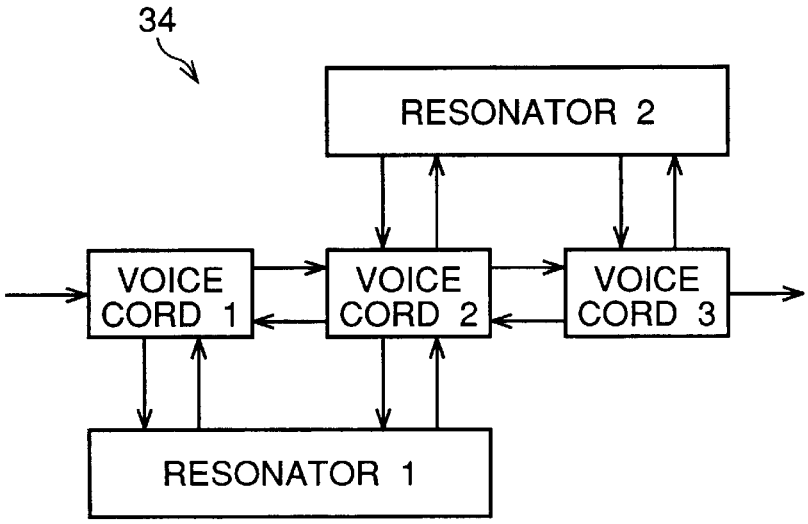
Figure 5A:
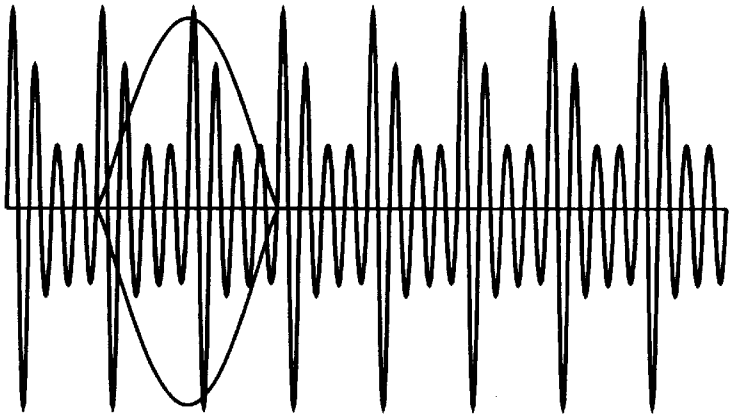
FIG. 5(A) through FIG. 5(D) are diagrams illustrating stages of an audio signal treated in the above-mentioned audio signal processor.
Figure 5B:
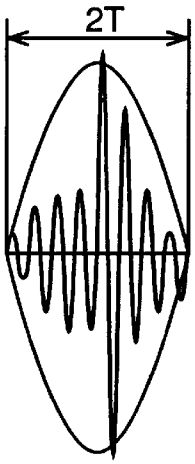

FIGS. 4(A) and 4(B) are block diagrams illustrating functions of the audio signal processor 3. The audio signal processor 3 incorporates a DSP (Digital Signal Processor) to process a audio signal through a microprogram. These figures show in a block diagram the functions to be executed by this microprogram. FIGS. 5(A) through FIG. 7(B) show examples of audio signals processed by the various functional blocks shown in FIGS. 4(A) and 4(B). An audio signal inputted from the microphone 7 through the control amplifier 2 is converted by an A/D converter 30 into digital waveform data. The digital waveform data is inputted into those of a waveform extractor 31 and a frequency detector 36. The frequency detector 36 detects the fundamental frequency of this waveform data, and supplies the detected fundamental frequency to the waveform extractor 31 as frequency data and, at the same time, to the CPU 10 through the interface. The waveform extractor 31 operates based on the frequency data supplied from the frequency detector 36 to extract two periods of the waveform data by a window function such as a Hamming function or a Hanning function as shown in FIGS. 5(A) and 5(B). The two periods of waveform data are extracted by use of the above-mentioned window function to retain the frequency spectrum of the original waveform data. The Hanning function is described in a paper "An Efficient Method for Pitch Shifting Digitally Sampled Sounds" Keith Lent, Departments of Music and Electrical Engineering, University of Texas at Austin, Tex. 78712 USA, Computer Music Journal, Vol. 13, No. 4, Winter 1989. The whole description of this paper is herein incorporated into this specification by the reference thereto.

Figure 5C:
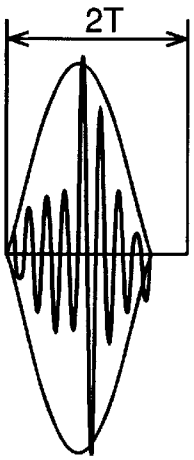

To convert a male voice into a female voice, the male voice is compressed by a compressor/expander 32 by increasing a rate or speed of a read clock for this extracted waveform data by about 20 percent, thereby shortening the temporal length of the extracted waveform data by about 20 percent as shown in FIG. 5(C). This shifts the formant of the extracted waveform data upward by about 20 percent. This is the simulation made on assumption that a female is smaller than a male in resonators such as voice cord, voice tract, chest, and head by about 20 percent and accordingly higher in formant frequency by about 20 percent. The extracted waveform data shifted in formant is inputted in a waveform synthesizer 33. The waveform synthesizer 33 repetitively reads this extracted waveform data at frequency 2F (period: ½F), which is two times as high as frequency F detected by the frequency detector 36, thereby synthesizing a continuous waveform as shown in FIG. 6(B). The frequency of the continuous waveform composed of the repetitively synthesized waveform data outputted from the waveform synthesizer 33 becomes two times as high as the frequency of the inputted audio signal, or becomes higher than the inputted singing voice by one octave. Thus, by doubling the frequency and by shifting the formant by about 20 percent upward, a male voice can be converted into a female voice.

Figure 5D:
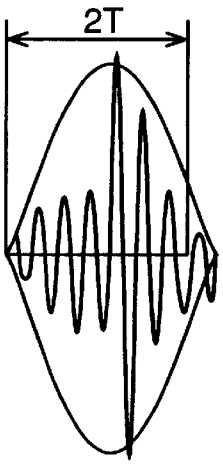

On the other hand, to convert a female voice into a male voice, the read clock for the extracted waveform data is delayed by about 20 percent to increase the temporal length of the extracted waveform data by about 20 percent as shown in FIG. 5(D). This operation shifts the formant of the extracted waveform data downward by about 20 percent. This is the simulation made on assumption that a male is greater than a female in resonator composed of voice cord, voice tract, chest, and head by about 20 percent and accordingly lower in formant frequency by about 20 percent. The extracted waveform data shifted in formant is inputted in the waveform synthesizer 33. The waveform synthesizer 33 repetitively reads this extracted waveform data at frequency ½F (period: 2/F), which is a half of frequency F detected by the frequency detector 36, thereby synthesizing a continuous waveform as shown in FIG. 6(C). The frequency of the continuous waveform of the repetitively synthesized waveform data outputted from the waveform synthesizer 33 becomes a half of the frequency of the inputted audio signal, or becomes lower than the inputted singing voice by one octave. Thus, by halving the frequency and by shifting the formant by about 20 percent downward, a female voice is converted into a male voice.

Generally, the male-to-female voice conversion and the female-to-male voice conversion are performed as described above. In addition, in the present karaoke apparatus, at performing a karaoke song, an adjustment coefficient corresponding to the voice quality of the original singer entitled to the karaoke song is inputted in the compressor/expander 32. This adjustment coefficient is read from the voice change parameter table according to the name of the original singer to adjust a default ratio of compression and expansion of 20 percent according to the characteristic of the voice of the original singer. To be more specific, if the original singer is relatively large in physique and has a deep voice, the temporal length of the extracted waveform data is increased to lower the formant frequency. If the original singer has a thin voice, the temporal length of the extracted waveform data is decreased to raise the formant frequency.

Figure 7A:
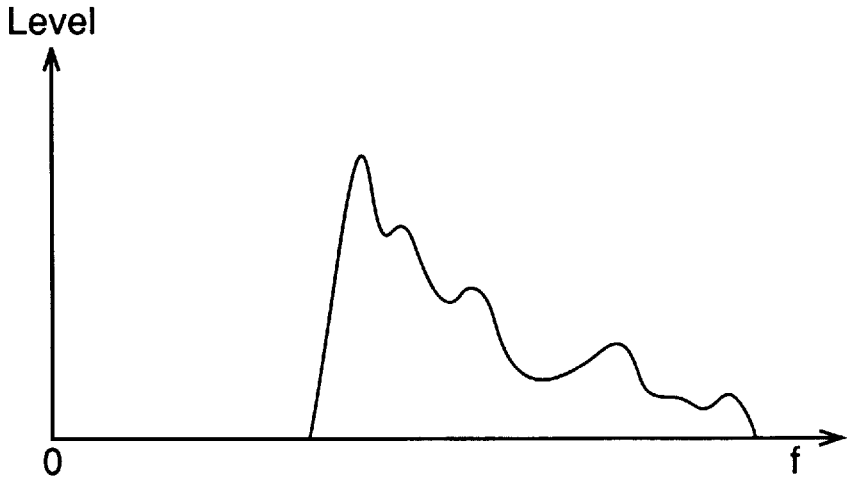
FIG. 7(A) and FIG. 7(B) are diagrams illustrating stages of an audio signal treated in the above-mentioned audio signal processor.
Figure 7B:
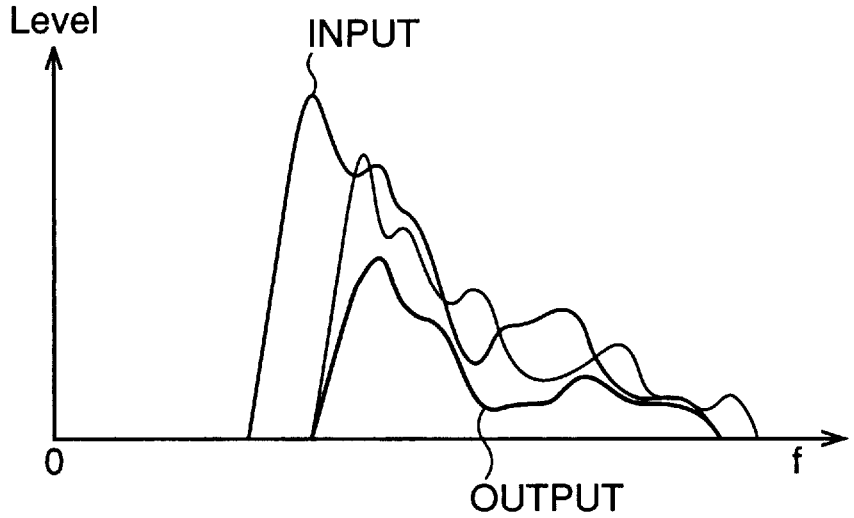

The synthesized waveform data converted from male voice to female voice or vice versa is outputted from the waveform synthesizer 33, and is inputted in a filter 34. The filter 34 has constitution as shown in FIG. 4(B), and simulates voice transmission in a resonator composed of human voice cord, chest, and head. In the filter components equivalent to voice cords 1 through 3 and resonators 1 and 2, parameters for defining the shapes of the resonant organs are inputted from the CPU 10. A set of these parameters for defining these shapes are provided in the form of the above-mentioned filter coefficients. As described above, one set of the filter coefficients has been obtained by simulating the resonant system of a particular original singer. The frequency characteristic of the entire filter 34 has a shape as shown in FIG. 7(A). Waveform data having a spectrum as shown in FIG. 7(B) may be inputted instead of a voice cord vibration signal to approximate the characteristic of the output waveform data or the formant frequency to that of the original singer. The waveform data passed through the filter 34 is converted by a D/A converter 35 into an audio signal to be inputted in the control amplifier 2.

The control amplifier 2 inputs the audio signal coming from the microphone 7 into the audio signal processor 3 without mixing with a karaoke performance tone. The audio signal converted into the waveform emulating the waveform of the voice of the original singer is inputted again into the control amplifier 2 to be mixed with the karaoke performance tone and the resultant audio signal is sounded from the loudspeaker 5.

Figure 6A:
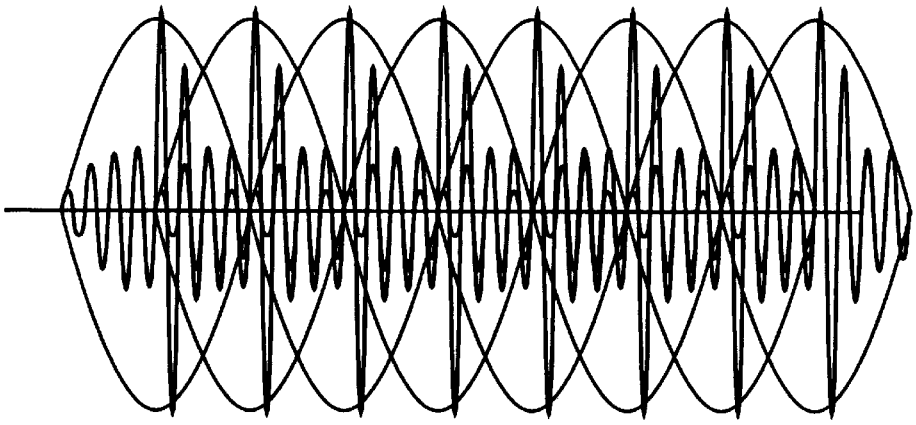
FIG. 6(A) through FIG. 6(C) are diagrams illustrating stages of an audio signal treated in the above-mentioned audio signal processor.
Figure 6B:
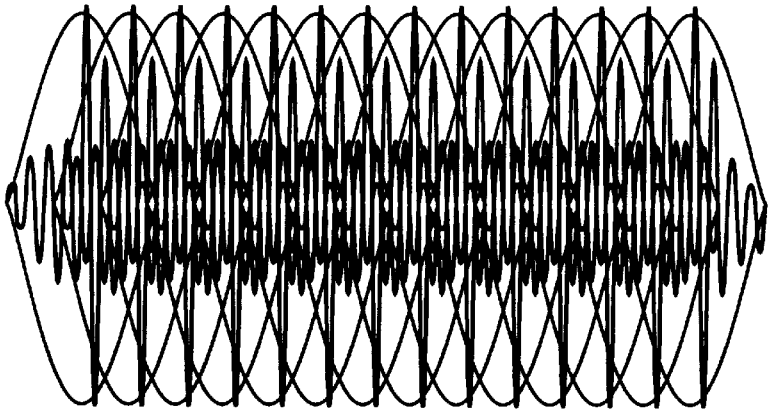
Figure 6C:
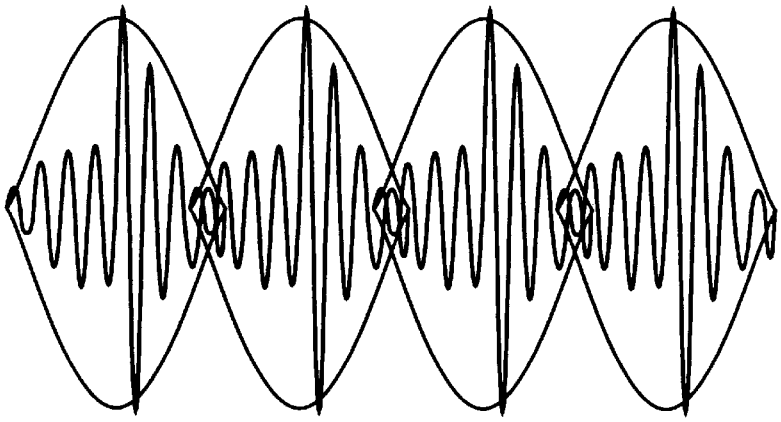

When a male karaoke player sings a male song or a female karaoke player sings a female song, the compressor/expander 32 performs only compression/expansion of the extracted waveform data by the adjustment coefficient as shown in FIG. 6(A), and the waveform synthesizer 33 repetitively synthesizes the extracted waveform data in the frequency detected by the frequency detector 36.

Referring back to FIGS. 1 and 4(A), the inventive voice processing apparatus modulates an input voice into an output voice according to a parameter set. In the voice processing apparatus, an input device is provided in the form of the microphone 7 that inputs an audio signal which represents an input voice having a frequency spectrum specific to the input voice. A processor device is provided in the form of the audio signal processor 3 that is configured by a parameter set to process the audio signal according to the parameter set to modify the frequency spectrum of the input voice. A parameter table is provided in the hard disk drive 17 for storing a plurality of parameter sets, each of which differently characterizes modification of the frequency spectrum by the processor device. A controller device is provided in the form of the CPU 10 that selects a desired one of the parameter sets from the parameter table, and that configures the processor device by the selected parameter set. An output device is provided in the form of the loudspeaker 5 that outputs the audio signal which is processed by the processor device and which represents an output voice characterized by the selected parameter set.

Specifically, the input device inputs an input voice in the form of vocal performance of a song originally entitled to a particular singer. The parameter table stores a plurality of parameter sets which are provisionally prepared in correspondence to different singers including the particular singer. The controller device selects the parameter set corresponding to the particular singer so that the output device outputs an output voice which can emulate vocal performance of the song by the particular singer.

Expediently, the input device may input an input voice having a pitch in a particular range. The parameter table may store a plurality of parameter sets which are provisionally prepared in correspondence to different ranges including the particular range. The controller device may select the parameter set corresponding to the particular range so that the output device outputs an output voice which can be modulated to adapt to the particular range.

Specifically, the processor device includes the compressor/expander 32 for variably compressing or expanding a waveform extracted from the audio signal according to a compression/expansion rate contained in the parameter set so as to shift a formant of the frequency spectrum of the input voice. Further, the processor device includes the filter 34 for variably filtering the audio signal according to a filtering coefficient contained in the parameter set so as to modify a shape of the frequency spectrum of the input voice.

Figure 8:
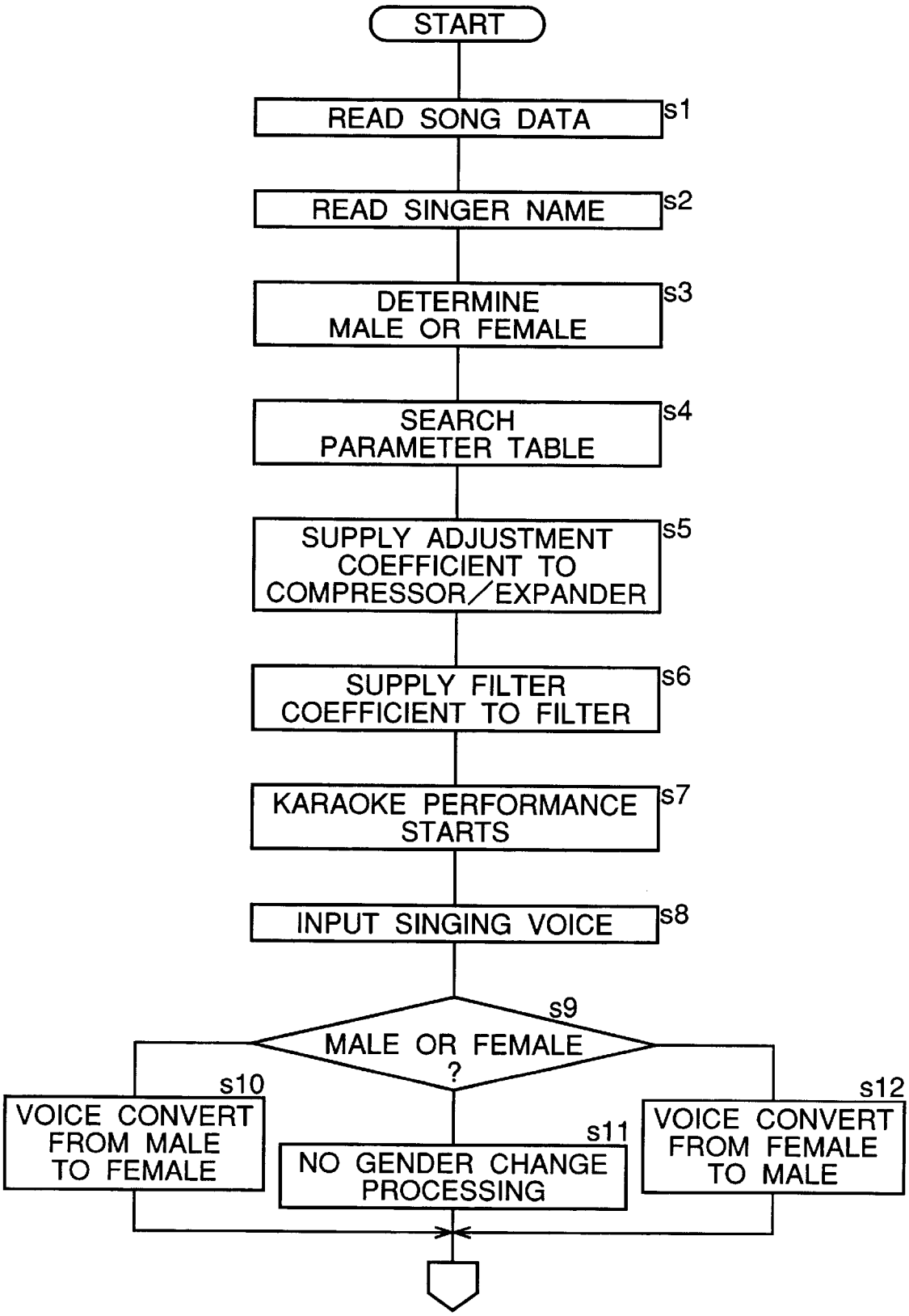
FIG. 8 is a flowchart indicative of operation of the above-mentioned karaoke apparatus.

FIG. 8 is a flowchart indicative of the operation of the present karaoke apparatus. This flowchart especially shows the operation to be performed at starting karaoke performance. When a song is selected by its song number and an application program for karaoke performance is started, the song data specified by the song number is read from the hard disk drive 17, and the read song data is stored in an execution data storage area of the RAM 12 (step s1). From the header of this song data, the name of the original singer is read (step s2). Whether the original singer is male or female is determined (step s3). The voice change parameter table is searched by the name of this original singer (step s4). Of a set of the voice change parameters found for the singer name, the adjustment coefficient is supplied to the compressor/expander 32 (step s5), and the filter coefficient is supplied to the filer 34 (step s6). Then, karaoke performance is started (step s7). When karaoke performance starts, the karaoke player sings in synchronization with karaoke performance, and an audio signal of the singing voice is inputted in the karaoke apparatus through the microphone 7. Based on the frequency of this audio signal, it is determined whether the karaoke player is male or female (step s8). Further, the gender of the karaoke player is compared with the gender of the original singer (step s9). If the karaoke player is male and the original singer is female, the male-to-female voice conversion is indicated to the compressor/expander 32 and the waveform synthesizer 33 (step s10). Conversely, if the karaoke player is female and the original singer is male, the female-to-male voice conversion is indicated to the compressor/expander 32 and the waveform synthesizer 33 (step s12). If the karaoke player and the original singer have the same gender, the compressor/expander 32 and the waveform synthesizer 33 are notified of that fact(step s11). For the male-to-female voice conversion, the compressor/expander 32 compresses the extracted waveform data by 20 percent. For the female-to-male voice conversion, the compressor/expander 32 expands the extracted waveform data by 20 percent. For the male-to-female voice conversion, the waveform synthesizer 33 repetitively overlaps the extracted waveform data at a frequency two times as high as the frequency of the audio signal. For the female-to-male voice conversion, the waveform synthesizer 33 repetitively overlaps the extracted waveform data at a frequency which is a half of the frequency of the initial audio signal. Consequently, the voice of either male or female karaoke player can be sounded in the voice emulating the original singer.

As described above, the first embodiment of the inventive karaoke apparatus generates a karaoke accompaniment to support a singing voice of a karaoke song while modulating the singing voice according to a parameter set. In the karaoke apparatus, generating means is provided in the form of the tone generator 18 for generating the karaoke accompaniment. Input means is provided in the form of the microphone 7 for inputting the singing voice having a specific frequency spectrum in parallel to the karaoke accompaniment. Processing means is provided in the form of the audio signal processor 3 configurable by a parameter set for processing the singing voice according to the parameter set to modify the frequency spectrum of the singing voice. Providing means is constituted by the hard disk drive 17 for providing a plurality of parameter sets, each of which differently characterizes modification of the frequency spectrum of the singing voice by the processing means. Control means is provided in the form of the CPU 10 for selecting a desired one of the parameter sets provided from the providing means, and for configuring the processing means by the selected parameter set. Output means is provided in the form of the loudspeaker 5 for outputting the singing voice which is processed by the processing means and which is modulated according to the selected parameter set to adapt to the karaoke song. Specifically, the input means inputs a singing voice of a karaoke song originally entitled to a particular singer. The providing means provides a plurality of parameter sets which are provisionally prepared in correspondence to different singers including the particular singer. The control means selects the parameter set corresponding to the particular singer so that the output means outputs the singing voice which can emulate vocal performance of the karaoke song by the particular singer.

Figure 10:
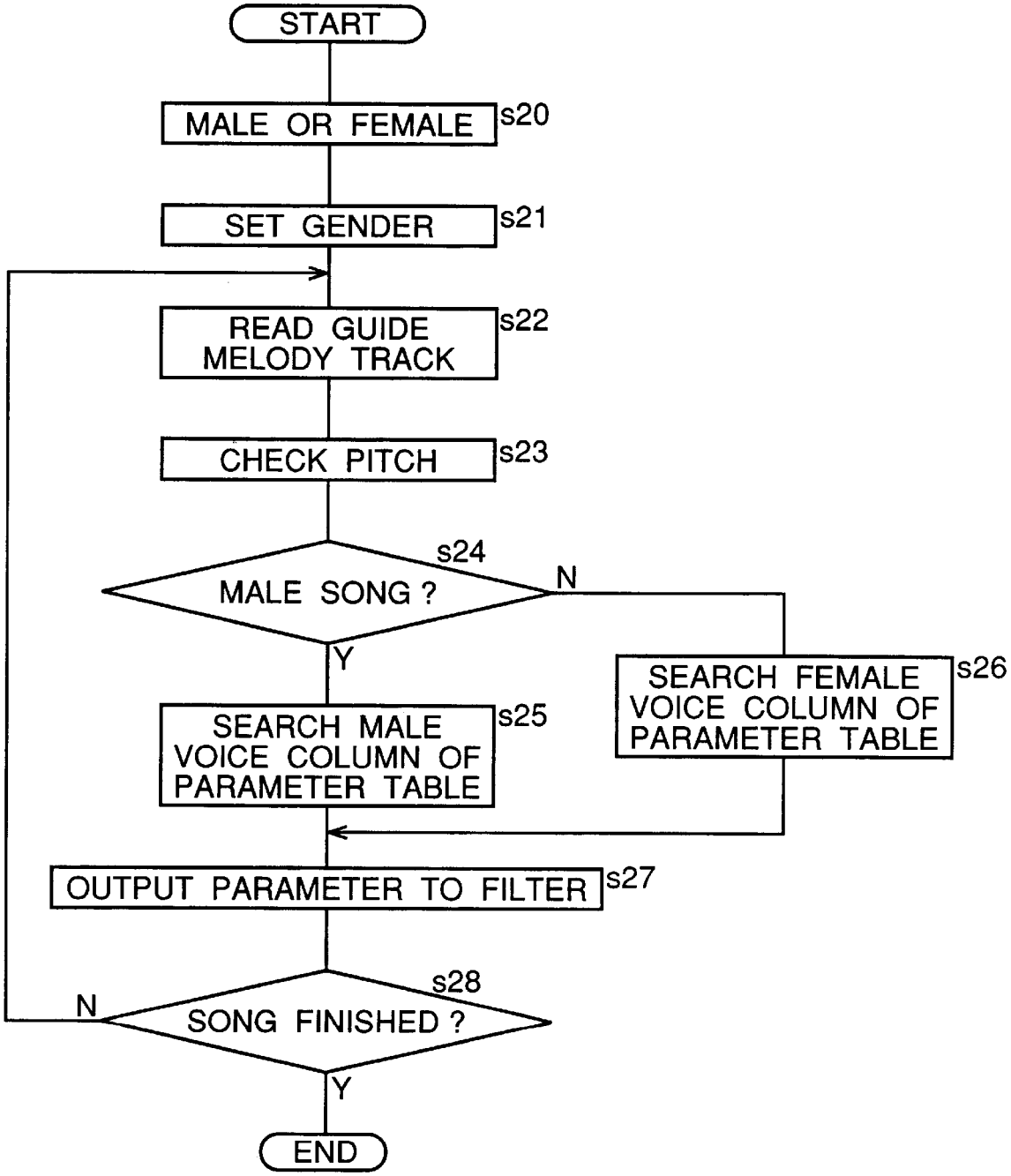
FIG. 10 is a flowchart indicative of operation of the above-mentioned second preferred embodiment.

FIGS. 9 and 10 are diagrams illustrating a karaoke apparatus practiced as a second preferred embodiment of the invention. In the above-mentioned first preferred embodiment, the parameter setting in the audio signal processor 3 is performed according to the original singer of the karaoke song to simulate the resonance system of the original singer. The second preferred embodiment focuses in the fact that the spectrum shape of an audio signal varies with a singing voice pitch range. In order to provide more realistic sounding conversion between male and female voices, in the second preferred embodiment, a voice change parameter table having contents shown in FIG. 9 is stored in the hard disk drive 17. This voice change parameter table contains filter coefficients corresponding to the voice pitch ranges classified by male and female. The filter 34 shown in FIG. 4(B) is configured to simulate the fact that, when singing in a high voice pitch range, the sound is resonated in the head by drawing back the chin for both male and female karaoke players. The filter 34 is also configured to simulate the fact that, when singing in a low voice pitch range, the sound is resonated in the chest by expanding. Thus, in the second embodiment, the parameter is selected based on the pitch of the guide melody data included in the song data, and is set to the audio signal generator 3.

FIG. 10 is a flowchart indicative of operation of the second preferred embodiment. The operation is conducted to change a parameter during karaoke performance. When karaoke performance starts, the gender of the karaoke player playing this karaoke song is determined based on the voice pitch range of the karaoke player (step s20). Based on the gender of the karaoke player, a predetermined conversion mode is indicated to the compressor/expander 32 and to the waveform synthesizer 33 (step s21). For male-to-female voice conversion, the compressor/expander 32 compresses the extracted waveform data by 20 percent. For female-to-male voice conversion, the compressor/expander 32 expands the extracted waveform data by 20 percent. For male-to-female voice conversion, the waveform synthesizer 33 sequentially and repetitively overlaps or connects the extracted waveform data at a frequency two times as high as the frequency of the audio signal. For female-to-male voice conversion, the waveform synthesizer 33 overlaps the extracted waveform data at a frequency which is a half of the frequency of the initial audio signal. Concurrently with the performance of the karaoke song, the data is read from the guide melody track (step s22). The pitch of this guide melody is detected (step s23). Then, it is determined whether this song is for male or female (step s24). If the song is found for male, the voice change parameter corresponding to the pitch detected in step s23 is obtained from a male voice column of the voice change parameter table shown in FIG. 9 (step s25). The obtained parameter is set to the filter 34 as a filter coefficient (step s27). On the other hand, if the song is found for female, the voice change parameter corresponding to the pitch detected in step s23 is obtained from a female voice column of the voice change parameter table shown in FIG. 9 (step s26). The obtained parameter is set to the filter 34 as a filter coefficient (step s27). The above-mentioned operations are repeated until it is determined that the song has come to an end. Consequently, when a male karaoke player sings a song entitled to a female original singer, if the voice pitch range of the male karaoke player is shifted by one octave, the male karaoke player can sing the part in the high voice pitch range more easily than a female karaoke player actually does. By use of spectrum conversion, the voice quality of the male karaoke player can be converted into a voice quality that sounds like the voice quality in the high voice pitch range.

As described above, in the second embodiment of the invention, the input means inputs a singing voice having a pitch which sequentially varies among a plurality of pitch ranges. The providing means provides a plurality of parameter sets which are provisionally prepared in correspondence to the plurality of the pitch ranges. The control means sequentially selects a parameter set corresponding to a target pitch range in which the pitch of the singing voice falls so that the output means outputs the singing voice which can be modulated to dynamically adapt to the pitch range of the singing voice during the course of the karaoke performance. Further, sequencer means time-sequentially provides performance data so that the generating means generates the karaoke accompaniment according to the performance data time-sequentially provided from the sequencer means, while the control means time-sequentially selects the parameter set corresponding to the target pitch range according to guide melody contained in the performance data and correlated to the pitch of the singing voice.

Figure 11:
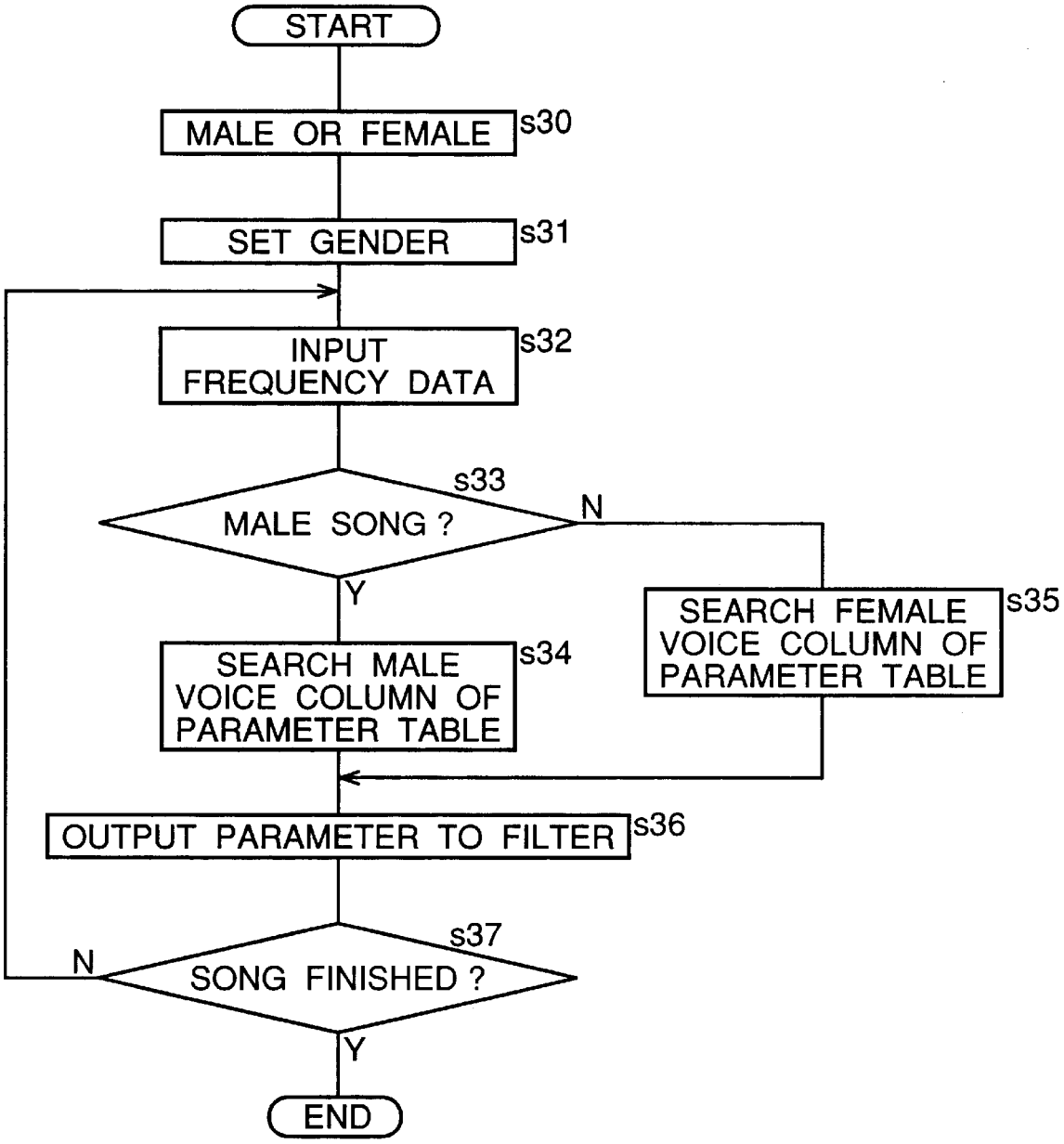
FIG. 11 is a flowchart indicative of operation of a karaoke apparatus practiced as a third preferred embodiment of the invention.

FIG. 11 is a flowchart indicative of a karaoke apparatus practiced as a third preferred embodiment of the invention. In the above-mentioned second preferred embodiment, the voice pitch range is determined based on the guide melody data of the song data. Based on the determined voice pitch range, the voice change parameter is selected from the voice change parameter table. In this third preferred embodiment, the voice change parameter is selected based on the frequency of an actual audio signal detected by the frequency detector 36 in the audio signal processor 3. Referring to FIG. 11, when karaoke performance starts, the gender of the karaoke player is determined (step s30). Based on the gender of the original singer of this karaoke song, a predetermined conversion mode is indicated to the compressor/expander 32 and to the waveform synthesizer 33 (step s31). For male-to-female voice conversion, the compressor/expander 32 compresses the extracted waveform data by 20 percent. For female-to-male voice conversion, the compressor/expander 32 expands the extracted waveform data by 20 percent. For male-to-female voice conversion, the waveform synthesizer 33 overlaps the extracted waveform data at a frequency two times as high as the frequency of the audio signal. For female-to-male voice conversion, the waveform synthesizer 33 overlaps the extracted waveform data at a frequency which is a half of the frequency of the initial audio signal. Then, the frequency data of the audio signal of the karaoke player is inputted from the audio signal processor 3 (step s32) to the CPU 10. It is determined whether this song is entitled to a male or female original singer (step s33). If this song is found entitled to a male original singer, the voice change parameter corresponding to the pitch inputted in step s32 is obtained from the male voice column of the voice change parameter table shown in FIG. 9 (step s34). The obtained parameter is set to the filter 34 as a filter coefficient (step s36). On the other hand, if the song is entitled to a female original singer, the voice change parameter corresponding to the pitch inputted in step s32 is obtained from the female voice column of the voice change parameter table shown in FIG. 9 (step s35). The obtained parameter is set to the filter 34 as a filter coefficient (step s36). These operations are repeated until it is determined that the song has come to an end (step s37). In the third preferred embodiment, when a male karaoke player sings a song entitled to a female original singer, if the voice pitch range of the male karaoke player is shifted by one octave, the male karaoke player can sing the part in the high voice pitch range more easily than a female karaoke player actually does. By use of spectrum conversion, the voice quality of the male karaoke player can be converted into a voice quality that sounds like the voice quality in the high voice pitch range.

As described above, in the third embodiment of the invention, the input means inputs a singing voice having a pitch which sequentially varies among a plurality of pitch ranges. The providing means provides a plurality of parameter sets which are provisionally prepared in correspondence to the plurality of the pitch ranges. The control means sequentially selects a parameter set corresponding to a target pitch range in which the pitch of the singing voice falls so that the output means outputs the singing voice which can be modulated to dynamically adapt to the pitch range of the singing voice during the course of the karaoke performance. Specifically, the control means includes means connected to the frequency detector 36 for detecting the pitch of the singing voice to identify the target pitch range in which the detected pitch of the singing voice falls, thereby selecting the parameter set corresponding to the target pitch range.

Figure 13:
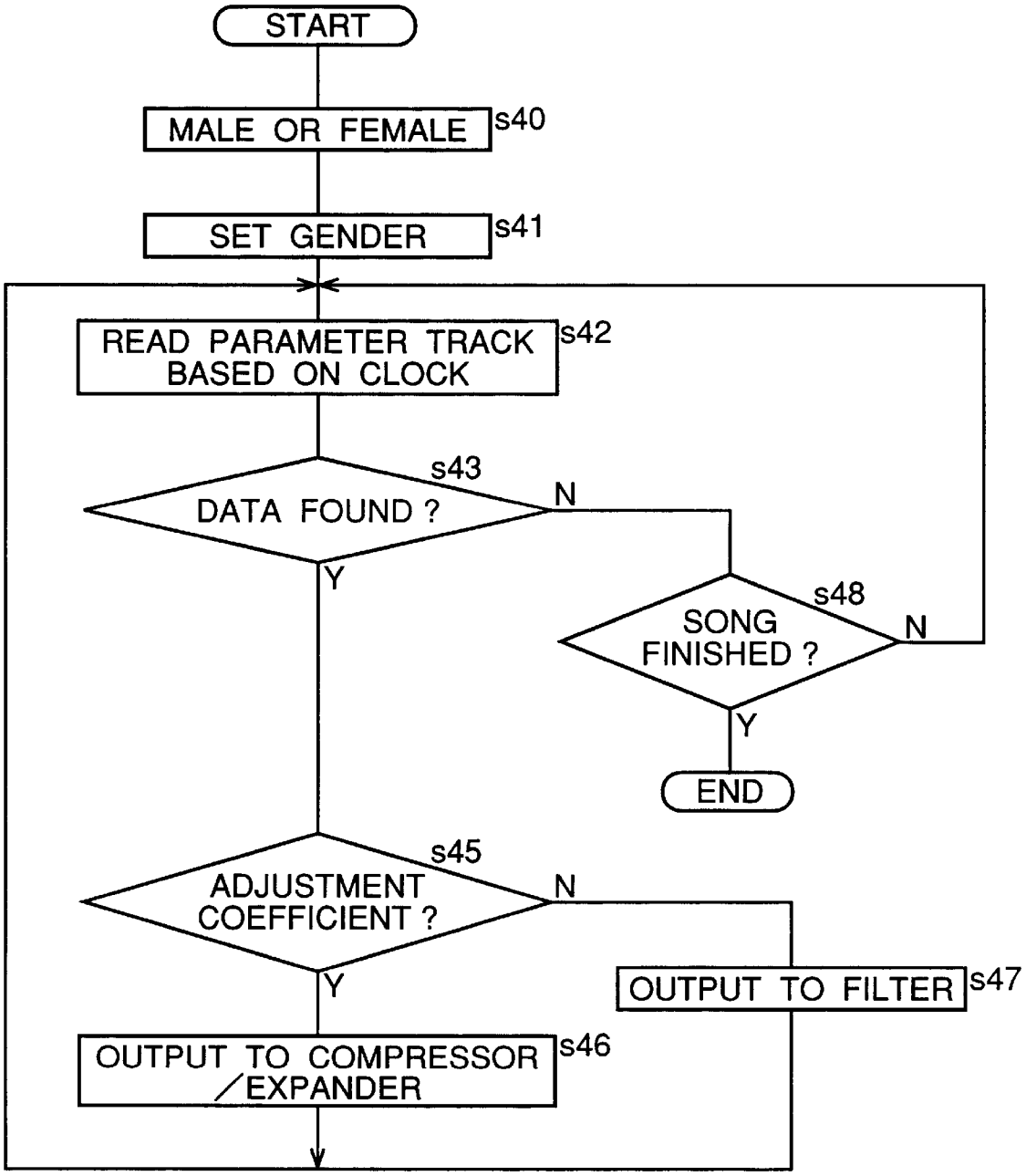
FIG. 13 is a flowchart indicative of operation of the above-mentioned fourth preferred embodiment.

FIGS. 12 and 13 are diagrams illustrating a karaoke apparatus practiced as a fourth preferred embodiment. In the fourth preferred embodiment, sequence data of voice change parameters is written to the song data beforehand, and these voice change parameters are loaded into the audio signal processor 3 as the song progresses. As shown in FIG. 12, the song data used in this embodiment has a voice change parameter track in addition to the constitution of the song data shown in FIG. 2. Likewise the other tracks, this voice change parameter track is written in a MIDI format. The voice change parameters are written as even data in a system exclusive message. Alternatively, the actual voice change parameters may be stored in the voice change parameter table beforehand as shown in FIGS. 3 and 9, while sequence data for specifying the parameters may be written in the form of the event data on the voice change parameter track.

FIG. 13 is a flowchart indicative of the operation of the fourth preferred embodiment. First, when karaoke performance starts, the gender of the karaoke player is determined based on the voice pitch range (step s40). Based on the gender of the original singer of this karaoke song, a predetermined conversion mode is instructed to the compressor/expander 32 and to the waveform synthesizer 33 (step s41). For male-to-female voice conversion, the compressor/expander 32 compresses the extracted waveform data by 20 percent. For female-to-male voice conversion, the compressor/expander 32 expands the extracted waveform data by 20 percent. For male-to-female voice conversion, the waveform synthesizer 33 overlaps the extracted waveform data at a frequency two times as high as the frequency of the audio signal. For female-to-male voice conversion, the waveform synthesizer 33 overlaps the extracted waveform data at a frequency which is a half of the frequency of the initial audio signal.

Based on the tempo clock for controlling the progression of the karaoke song, the voice change parameter track is read (step s42). If the read control data is found (step s43), it is determined whether the read control data is an adjustment coefficient, or it is determined whether this read control data is data for specifying an adjustment coefficient in the voice change parameter table (step s45). If the read control data is found to be an adjustment coefficient, the same is outputted to the compressor/expander 32 (step s46). If the read control data is found to be the adjustment coefficient specifying data, the adjustment coefficient specified by this data is read from the voice change parameter table and the adjustment coefficient is outputted to the compressor/expander 32. On the other hand, if the read control data is found to be a filter coefficient, the same is outputted to the filter 34 (step s47). If the read control data is found to be filter coefficient specifying data, the filter coefficient specified by this control data is read from the voice change parameter table, and the filter coefficient is outputted to the filter 34. These operations are repeated until the song comes to an end (step s48). This constitution allows appropriate automatic voice change in synchronization with progression of the karaoke song. In the fourth preferred embodiment, the audio signal processing according to the invention is applied to the karaoke apparatus. It will be apparent that this audio signal processor is also applicable to other amusement and entertainment machines.

As described above, in the fourth embodiment of the invention, the control means time-sequentially selects the parameter sets provided from the providing means during the course of the karaoke performance, and time-variably configures the processing means by the time-sequentially selected parameter sets so that the output means outputs the singing voice which is time-variably modulated according to the time-sequentially selected parameter sets to dynamically adapt to the karaoke song during the course of the karaoke performance. In such a case, the karaoke apparatus is further comprised of sequencer means which may be a software module executed by the CPU 10 for time-sequentially providing a track of performance data and another track of control data so that the generating means generates the karaoke accompaniment according to the performance data time-sequentially provided from the sequencer means, while the control means time-sequentially selects the parameter sets provided from the providing means according to the control data time-sequentially provided from the sequencer means in synchronization with the performance data.

The present invention covers the method designed for generating a karaoke accompaniment to support a singing voice of a karaoke song while modulating the singing voice by the audio signal processor 3 configurable by a parameter set for processing the singing voice according to the parameter set to modify a frequency spectrum of the singing voice. The inventive method is carried out by the steps of generating the karaoke accompaniment, inputting the singing voice having a specific frequency spectrum in parallel to the karaoke accompaniment, providing a plurality of parameter sets, each of which differently characterizes modification of the specific frequency spectrum of the singing voice by the processor 3, selecting a desired one of the provided parameter sets, configuring the processor 3 by the selected parameter set, and outputting the singing voice which is processed by the processor 3 and which is modulated according to the selected parameter set to adapt to the karaoke song.

Specifically, the step of selecting time-sequentially selects the provided parameter sets during the course of the karaoke performance. The step of configuring time-variably configures the processor 3 by the time-sequentially selected parameter sets so that the step of outputting outputs the singing voice which is time-variably modulated according to the time-sequentially selected parameter sets to dynamically adapt the singing voice to the karaoke song during the course of the karaoke performance. The inventive method further includes the step of time-sequentially providing a track of performance data and another track of control data so that the karaoke accompaniment is generated according to the time-sequentially provided performance data, while the step of selecting time-sequentially selects the parameter sets according to the control data time-sequentially provided in synchronization with the performance data.

Specifically, the step of inputting inputs a singing voice of a karaoke song originally entitled to a particular singer. The step of providing provides a plurality of parameter sets which are provisionally prepared in correspondence to different singers including the particular singer. The step of selecting selects the parameter set corresponding to the particular singer so that the step of outputting outputs the singing voice which can emulate vocal performance of the karaoke song by the particular singer.

Specifically, the step of inputting inputs a singing voice having a pitch which sequentially varies among a plurality of pitch ranges. The step of providing provides a plurality of parameter sets which are provisionally prepared in correspondence to the plurality of the pitch ranges. The step of selecting sequentially selects a parameter set corresponding to a target pitch range in which the pitch of the singing voice falls so that the step of outputting outputs the singing voice which can be modulated to dynamically adapt to the pitch range of the singing voice during the course of the karaoke performance.

The invention further covers the machine readable medium 26 for use in the karaoke apparatus 1 having the CPU 10 for generating a karaoke accompaniment to support a singing voice of a karaoke song while modulating the singing voice by the processor 3 configurable by a parameter set for processing the singing voice according to the parameter set to modify a frequency spectrum of the singing voice. The machine readable medium 26 contains program instructions executable by the CPU 10 for causing the karaoke apparatus 1 to perform the steps of generating the karaoke accompaniment, inputting the singing voice having a specific frequency spectrum in parallel to the karaoke accompaniment, providing a plurality of parameter sets, each of which differently characterizes modification of the specific frequency spectrum of the singing voice by the processor 3, selecting a desired one of the provided parameter sets, configuring the processor 3 by the selected parameter set, and outputting the singing voice which is processed by the processor 3 and which is modulated according to the selected parameter set to adapt to the karaoke song.

As described and according to the first aspect of the invention, a plurality of parameters for defining the modes of manipulating input voice waveforms are stored in a parameter table. One of these parameters can be supplied to processing means to manipulate audio signals in a desired manner with simple setting. As described and according to the second aspect of the invention, parameters indicative of the characteristics of a plurality of original or model singers are stored in a parameter table. By supplying one of these parameters according to a song requested by a karaoke player to the processing means, the waveform of an audio signal can be converted into a waveform emulating the voice of the original singer entitled to the requested song. For example, when the parameter of the original singer of the requested song is set, the singing voice emulating the original singing of that song can be realized with ease. As described and according to the third aspect of the invention, parameters corresponding to a plurality of voice pitch ranges are stored in a parameter table. By supplying the parameter corresponding to the voice pitch range of an inputted audio signal to the processing means, the inputted audio signal can be manipulated in a manner suitable for the voice pitch range of the inputted audio signal. As described and according to the fourth aspect of the invention, parameters for specifying manners of manipulating the fundamental frequency and frequency spectrum shape of an audio signal are written to a track of song data as sequence data. The voice quality of an audio signal is manipulated based on the parameters as the karaoke song progresses. This novel constitution allows manipulation of the voice quality of the singing voice of a karaoke song into a voice quality matching scenes of the karaoke song, thereby outputting a singing voice rich in expression.

While the preferred embodiments of the present invention have been described using specific terms, such description is for illustrative purposes only, and it is to be understood that changes and variations may be made without departing from the spirit or scope of the appended claims.

What is claimed is:

1. A voice processing apparatus for modulating an input voice into an output voice according to a parameter set, comprising:

an input device that inputs an audio signal which represents an input voice having a frequency spectrum specific to the input voice;

a processor device that is configured by a parameter set to process the audio signal according to the parameter set to modify the frequency spectrum of the input voice;

a parameter table that stores a plurality of parameter sets, each of which differently characterizes modification of the frequency spectrum by the processor device;

a controller device that selects a desired one of the parameter sets from the parameter table, and that configures the processor device by the selected parameter set; and an output device that outputs the audio signal which is processed by the processor device and which represents an output voice characterized by the selected parameter set.

2. The voice processing apparatus according to claim 1, wherein the input device inputs an input voice in the form of vocal performance of a song originally entitled to a particular singer, the parameter table stores a plurality of parameter sets which are provisionally prepared in correspondence to different singers including the particular singer, and the controller device selects the parameter set corresponding to the particular singer so that the output device outputs an output voice which can emulate vocal performance of the song by the particular singer.

3. The voice processing apparatus according to claim 1, wherein the input device inputs an input voice having a pitch in a particular range, the parameter table stores a plurality of parameter sets which are provisionally prepared in correspondence to different ranges including the particular range, and the controller device selects the parameter set corresponding to the particular range so that the output device outputs an output voice which can be modulated to adapt to the particular range.

4. The voice processing apparatus according to claim 1, wherein the processor device includes a compressor/expander for variably compressing /expanding a waveform extracted from the audio signal according to a compression/expansion rate contained in the parameter set so as to shift a formant of the frequency spectrum of the input voice.

5. The voice processing apparatus according to claim 1, wherein the processor device includes a filter for variably filtering the audio signal according to a filtering coefficient contained in the parameter set so as to modify a shape of the frequency spectrum of the input voice.

6. A karaoke apparatus for generating a karaoke accompaniment to support a singing voice of a karaoke song while modulating the singing voice according to a parameter set, the karaoke apparatus comprising:

generating means for generating the karaoke accompaniment;

input means for inputting the singing voice having a specific frequency spectrum in parallel to the karaoke accompaniment;

processing means configurable by a parameter set for processing the singing voice according to the parameter set to modify the frequency spectrum of the singing voice;

providing means for providing a plurality of parameter sets, each of which differently characterizes modification of the frequency spectrum of the singing voice by the processing means;

control means for selecting a desired one of the parameter sets provided from the providing means, and for configuring the processing means by the selected parameter set; and output means for outputting the singing voice which is processed by the processing means and which is modulated according to the selected parameter set to adapt to the karaoke song.

7. The karaoke apparatus according to claim 6, wherein the control means time-sequentially selects the parameter sets provided from the providing means during the course of the karaoke performance, and time-variably configures the processing means by the time-sequentially selected parameter sets so that the output means outputs the singing voice which is time-variably modulated according to the time-sequentially selected parameter sets to dynamically adapt to the karaoke song during the course of the karaoke performance.

8. The karaoke apparatus according to claim 7, further comprising sequencer means for time-sequentially providing a track of performance data and another track of control data so that the generating means generates the karaoke accompaniment according to the performance data time-sequentially provided from the sequencer means, while the control means time-sequentially selects the parameter sets provided from the providing means according to the control data time-sequentially provided from the sequencer means in synchronization with the performance data.

9. The karaoke apparatus according to claim 6, wherein the input means inputs a singing voice of a karaoke song originally entitled to a particular singer, the providing means provides a plurality of parameter sets which are provisionally prepared in correspondence to different singers including the particular singer, and the control means selects the parameter set corresponding to the particular singer so that the output means outputs the singing voice which can emulate vocal performance of the karaoke song by the particular singer.

10. The karaoke apparatus according to claim 6, wherein the input means inputs a singing voice having a pitch which sequentially varies among a plurality of pitch ranges, the providing means provides a plurality of parameter sets which are provisionally prepared in correspondence to the plurality of the pitch ranges, and the control means sequentially selects a parameter set corresponding to a target pitch range in which the pitch of the singing voice falls so that the output means outputs the singing voice which can be modulated to dynamically adapt to the pitch range of the singing voice during the course of the karaoke performance.

11. The karaoke apparatus according to claim 10, wherein the control means includes means for detecting the pitch of the singing voice to identify the target pitch range in which the detected pitch of the singing voice falls, thereby selecting the parameter set corresponding to the target pitch range.

12. The karaoke apparatus according to claim 10, further comprising sequencer means for time-sequentially providing performance data so that the generating means generates the karaoke accompaniment according to the performance data time-sequentially provided from the sequencer means, while the control means time-sequentially selects the parameter set corresponding to the target pitch range according to the performance data correlated to the pitch of the singing voice.

13. A method of generating a karaoke accompaniment to support a singing voice of a karaoke song while modulating the singing voice by a processor configurable by a parameter set for processing the singing voice according to the parameter set to modify a frequency spectrum of the singing voice, the method comprising the steps of:

generating the karaoke accompaniment;

inputting the singing voice having a specific frequency spectrum in parallel to the karaoke accompaniment;

providing a plurality of parameter sets, each of which differently characterizes modification of the specific frequency spectrum of the singing voice by the processor;

selecting a desired one of the provided parameter sets;

configuring the processor by the selected parameter set; and outputting the singing voice which is processed by the processor and which is modulated according to the selected parameter set to adapt to the karaoke song.

14. The method according to claim 13, wherein the step of selecting time-sequentially selects the provided parameter sets during the course of the karaoke performance, and the step of configuring time-variably configures the processor by the time-sequentially selected parameter sets so that the step of outputting outputs the singing voice which is time-variably modulated according to the time-sequentially - selected parameter sets to dynamically adapt the singing voice to the karaoke song during the course of the karaoke performance.

15. The method according to claim 14, further comprising the step of time-sequentially providing a track of performance data and another track of control data so that the karaoke accompaniment is generated according to the time-sequentially provided performance data, while the step of selecting time-sequentially selects the parameter sets according to the control data time-sequentially provided in synchronization with the performance data.

16. The method according to claim 13, wherein the step of inputting inputs a singing voice of a karaoke song originally entitled to a particular singer, the step of providing provides a plurality of parameter sets which are provisionally prepared in correspondence to different singers including the particular singer, and the step of selecting selects the parameter set corresponding to the particular singer so that the step of outputting outputs the singing voice which can emulate vocal performance of the karaoke song by the particular singer.

17. The method according to claim 13, wherein the step of inputting inputs a singing voice having a pitch which sequentially varies among a plurality of pitch ranges, the step of providing provides a plurality of parameter sets which are provisionally prepared in correspondence to the plurality of the pitch ranges, and the step of selecting sequentially selects a parameter set corresponding to a target pitch range in which the pitch of the singing voice falls so that the step of outputting outputs the singing voice which can be modulated to dynamically adapt to the pitch range of the singing voice during the course of the karaoke performance.

18. A machine readable medium for use in a karaoke apparatus having a CPU for generating a karaoke accompaniment to support a singing voice of a karaoke song while modulating the singing voice by a processor configurable by a parameter set for processing the singing voice according to the parameter set to modify a frequency spectrum of the singing voice, the medium containing program instructions executable by the CPU for causing the karaoke apparatus to perform the steps of:

generating the karaoke accompaniment;

inputting the singing voice having a specific frequency spectrum in parallel to the karaoke accompaniment;

providing a plurality of parameter sets, each of which differently characterizes modification of the specific frequency spectrum of the singing voice by the processor;

selecting a desired one of the provided parameter sets;

configuring the processor by the selected parameter set; and outputting the singing voice which is processed by the processor and which is modulated according to the selected parameter set to adapt to the karaoke song.

19. The machine readable medium according to claim 18, wherein the step of selecting time-sequentially selects the provided parameter sets during the course of the karaoke performance, and the step of configuring time-variably configures the processor by the time-sequentially selected parameter sets so that the step of outputting outputs the singing voice which is time-variably modulated according to the time-sequentially selected parameter sets to dynamically adapt the singing voice to the karaoke song during the course of the karaoke performance.

20. The machine readable medium according to claim 19, wherein the steps further comprise time-sequentially providing a track of performance data and another track of control data so that the karaoke accompaniment is generated according to the time-sequentially provided performance data, while the step of selecting time-sequentially selects the parameter sets according to the control data time-sequentially provided in synchronization with the performance data.

21. The machine readable medium according to claim 18, wherein the step of inputting inputs a singing voice of a karaoke song originally entitled to a particular singer, the step of providing provides a plurality of parameter sets which are provisionally prepared in correspondence to different singers including the particular singer, and the step of selecting selects the parameter set corresponding to the particular singer so that the step of outputting outputs the singing voice which can emulate vocal performance of the karaoke song by the particular singer.

22. The machine readable medium according to claim 18, wherein the step of inputting inputs a singing voice having a pitch which sequentially varies among a plurality of pitch ranges, the step of providing provides a plurality of parameter sets which are provisionally prepared in correspondence to the plurality of the pitch ranges, and the step of selecting sequentially selects a parameter set corresponding to a target pitch range in which the pitch of the singing voice falls so that the step of outputting outputs the singing voice which can be modulated to dynamically adapt to the pitch range of the singing voice during the course of the karaoke performance.

* * * * *